United States Patent [19]

Bald

[11] 4,183,429

[45] Jan. 15, 1980

[54] APPARATUS IN A CIGARETTE PLANT

[75] Inventor: Hubert Bald, Gevelsberg, Fed. Rep. of Germany

[73] Assignee: Maschinenfabrik Alfred Schmermund GmbH & Co., Gevelsberg, Fed. Rep. of Germany

[21] Appl. No.: 785,705

[22] Filed: Apr. 7, 1977

[30] Foreign Application Priority Data

Apr. 27, 1976 [DE] Fed. Rep. of Germany ..... 2618297

[51] Int. Cl.[2] ..... B65G 43/08; B65G 43/10

[52] U.S. Cl. ..... 198/572; 198/855

[58] Field of Search ..... 198/572, 855, 503, 347, 198/571; 53/59 R, 64, 500

[56] References Cited

U.S. PATENT DOCUMENTS

| | | | |
|---|---|---|---|
| 2,916,792 | 12/1959 | Crook et al. | 198/572 X |
| 3,263,794 | 8/1966 | Burton | 198/503 X |
| 3,465,869 | 9/1969 | Benatar | 198/855 X |
| 3,944,049 | 3/1976 | Graybill | 198/503 X |

FOREIGN PATENT DOCUMENTS

| | | | |
|---|---|---|---|
| 1033281 | 6/1966 | United Kingdom | 198/571 |

OTHER PUBLICATIONS

"Pulse, Digital and Switching Waveforms", by Millman, J. and Taub, H., pp. 671-672 1965, McGraw-Hill.

*Primary Examiner*—Joseph E. Valenza
*Assistant Examiner*—Douglas D. Watts
*Attorney, Agent, or Firm*—Sughrue, Rothwell, Mion, Zinn and Macpeak

[57] ABSTRACT

There is disclosed apparatus in a high speed continuous cigarette processing plant for maintaining substantially constant the length of an accumulated layer of cigarettes. The apparatus comprises a carrier for carrying cigarettes in a predetermined direction, a charging device to displace the cigarette transversely to the respective longitudinal dimensions thereof and thereby to load the cigarettes onto the carrier to be accumulated thereon side-by-side in a single gapless layer, and a discharging device disposed downstream of the carrier to remove the cigarettes in uniform sequence from the carrier. The apparatus further comprises a device to provide a target signal indicative of the optimum length of the accumulated layer of cigarettes, a first sensor disposed to sense the passage of each cigarette loaded onto the charging device from the carrier and to provide a first signal indicative of the passage of each cigarette, a second sensor disposed to sense the passage of each cigarette removed from the charging device to the discharging device and to provide a second signal indicative of the passage of each cigarette, a reversible digital counter arranged to count forwardly in response to the first signal and to count backwardly in response to the second signal, and a control device responsive to a control signal indicative of an instantaneous count state of the reversible digital counter and responsive to the target signal to so control the rate at which the cigarettes are removed from the carrier by the discharging device that the length of the accumulated layer of cigarettes is maintained substantially constant.

1 Claim, 1 Drawing Figure

APPARATUS IN A CIGARETTE PLANT

The present invention relates to an apparatus in a cigarette plant. In a cigarette manufacturing and/or packaging plant it is common practice to provide between individual machines intermediate storage means for the cigarettes. For example, a short-term storage means, operating with only one layer of cigarettes, may be connected between a filter assembly machine and a trestle filling machine, because the upstream filter assembly machine may deliver cigarettes at an irregular rate, while the trestle filling machine always removes a given number of cigarettes in each consignment. It is known from the DT-OS No. 1 632 233 (Molins) in such a plant to load the cigarettes transversely to their length onto a rapidly running conveyor belt, along the length of which they accumulate before they are taken off by the trestle filling device. According to the known teaching, the operating speed of the trestle filler—which would subsequently be referred to as the "removal rate"—is made at most equal to the maximum feed rate of the cigarettes onto the belt, and the removal rate is so controlled in stepwise manner that sufficient cigarettes for the next filling operation are always available.

In some known arrangements, different lengths of the layer of accumulated cigarettes are maintained over a relatively long period in accordance with the operational state of the machine prevailing over that period.

Variations in length of the layer of accumulated cigarettes may arise solely as a result of different feed rates from the production machine connected in front of the trestle filling device.

Moreover, variations in the length of accumulated layer may arise as a result of certain inertia effects. For example, if a large number of successive cigarettes are ejected from the stream of cigarettes conveyed in a single layer by a cigarette testing and ejection unit disposed between the cigarette manufacturing machine and the trestle filling device, the trestle filling device is rendered inoperative. After completion of the ejection process, cigarettes are again supplied with a speed corresponding to the maximum production rate of the cigarette manufacturing machine. In these circumstance, the length of the accumulated layer increases rapidly during the period when trestle filling device is still inoperative. However, when the length of the accumulated layer reaches a predetermined value, the trestle filling device is switched on so as to operate at its maximum speed. In consequence of its inertia, the trestle filling device will attain this maximum conveying speed only after a certain period has elapsed after its being switched on. Thus, the length of the accumulated layer of cigarettes will have increased to an appreciable extent by the time the trestle filling device has reached its maximum speed.

This increased length of the accumulated layer is maintained until it is again reduced as a result of the cigarette manufacturing machine being operated at a reduced feed rate.

However, different lengths of the accumulated layer lead to difficulties in high-speed cigarette machines, when the length of the accumulated layer is too long, then such a great pressure acts on the cigarettes in the downstream end portion of the accumulated layer that the cigarettes may be pushed upwardly out of line or, when this is prevented by guide means, the cigarettes may become damaged by being squashed against one another. Such guide means are mostly provided at least shortly before the removal device so that the cigarettes are aligned in their longitudinal direction. This requires that no empty places are present at the guide means, because incoming cigarettes are otherwise not aligned, but cant over, set themselves obliquely and likewise disturb the routine of operation. The accumulation should also not be too short. A still further reason why the length of the accumulated layer should not be less than a given minimum length, even when the aforementioned guide means could be omitted or be arranged only in the region of the removing machine by constructional reformation, is that the carrier of removing machine has a certain unavoidable mechanical inertia so that it still continues to run for a short time after the switching-off of the machine due to the detection of a fault. During this run-down period, however, sufficient cigarettes must still be supplied from the accumulated layer to avoid any empty places occurring in the carrier of the cigarette removing machine.

The aforementioned difficulties can be at least substantially reduced by keeping the length of the accumulated cigarettes at an empirically found optimum value in all operational states of the associated cigarette processing plant.

Regulation of the cigarette removal rate is already generally known in cigarette plants. DT-OS No. 19 66 899 discloses an arrangement in which the cigarettes are fed in one layer in irregular sequence to a uniting zone, where they are vertically stacked and transported further as a complete stack. A sensor detects the pressure of the cigarettes piling up and influences the removal rate in such a sense as to maintain this pressure constant.

It is an object of the invention to provide an apparatus in which variations in the length of an accumulated layer of cigarettes, which results from different feed rates and from the effects of inertia of parts of the apparatus, may be minimized.

SUMMARY OF THE INVENTION

According to the present invention there is provided an apparatus in a high speed continuous cigarette processing plant for maintaining substantially constant the length of an accumulated layer of cigarettes, comprising carrier means for carrying cigarettes in a predetermined direction, charging means to displace said cigarettes transversely to the respective longitudinal dimensions thereof and thereby to load said cigarettes onto said carrier means to be accumulated thereon side-by-side in a single gapless layer, discharging means disposed downstream of said carrier means to remove said cigarettes in uniform sequence from said carrier means, means to provide a target signal indicative of the optimum length of said accumulated layer of cigarettes, first sensor means disposed to sense the passage of each cigarette loaded onto said charging means from said carrier means, and to provide a first signal indicative of said passage of each cigarette loaded onto said charging means, second sensor means disposed to sense the passage of each cigarette removed from said charging means to said discharging means and to provide a second signal indicative of said passage of each cigarette removed from said charging means, a reversible digital counter arranged to count forwardly in response to said first signal and to count backwardly in response to said second signal, and means responsive to a control signal indicative of an instantaneous count state of said reversible digital counter and responsive to said target signal to so control the rate at which said cigarettes are removed from said carrier means by said discharging means that said length of said accumulated layer of cigarettes is maintained substantially constant.

BRIEF DESCRIPTION OF THE DRAWING

An embodiment of the present invention will now be more particularly described, by way of example, with reference to the single FIGURE of the accompanying drawing.

DESCRIPTION OF THE PREFERRED EMBODIMENTS

Figure 1:
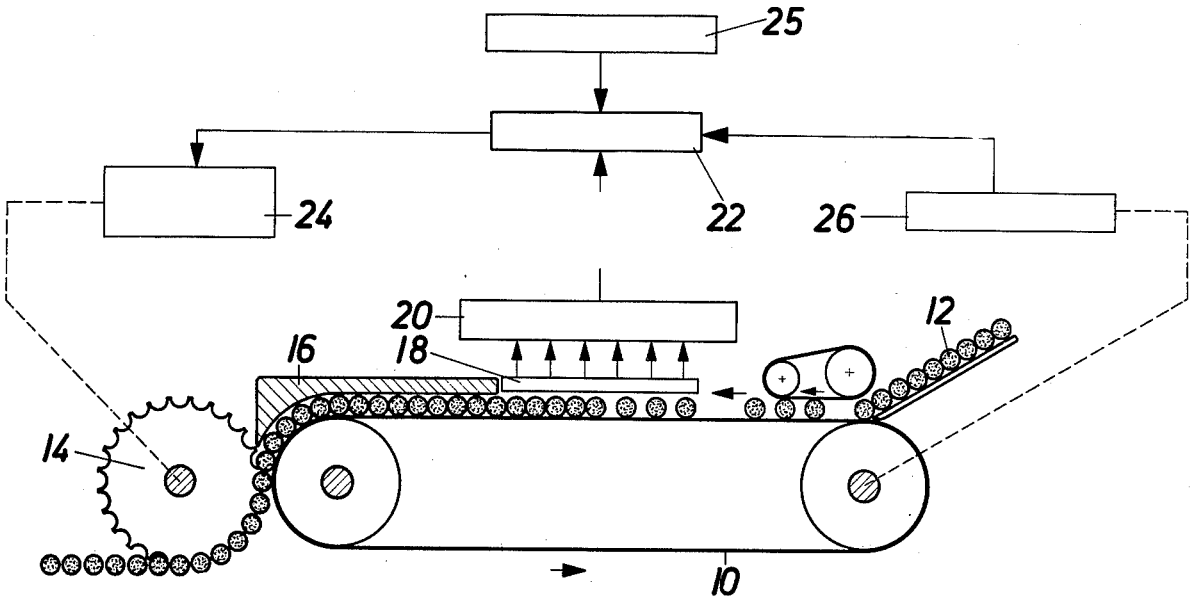
Figure 2:
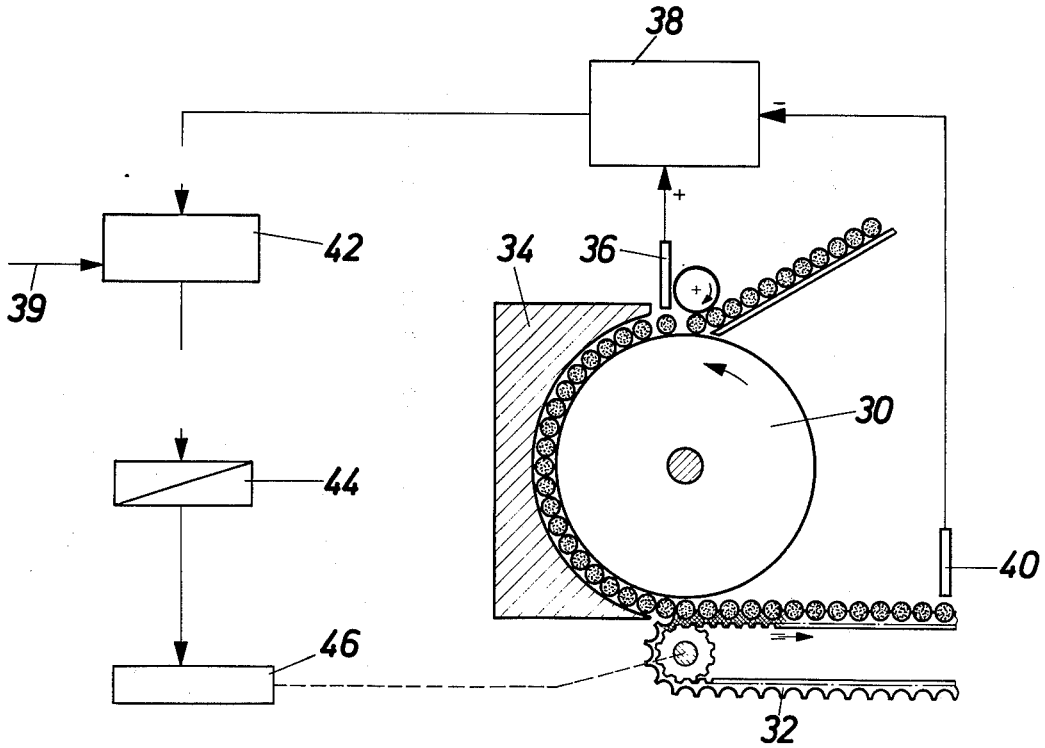

Referring now to the drawing, there is shown carrier means in the form of a conveyor drum 30. The cigarettes 12 are loaded with or without intermediate spacing from a preceding machine (not illustrated) by way of charging means represented schematically by a roller disposed above the drum 30. The cigarettes are singled at the latest on the conveyor drum 30 and fed to discharging means in the form of a trough belt 32. Guide means 34 are also provided.

The equipment for measuring the position of the last cigarette of the layer of accumulated cigarettes comprises a first detector 36, for example an air current detector, which detects the individual cigarettes as they move towards the layer of accumulated cigarettes and which causes a reversible digital counter 38 to step forward through one counting step for each such detected cigarette. A second detector 40 detects the passage of the removed cigarettes and controls a subtracting input of the counter 38 to cause the counter to count backwardly on each of the cigarettes being removed from the drum 30. In consequence thereof, the instantaneous state of the counter 38 represents the excess of the cigarettes being positioned on the conveyor 30 over the number of those removed and thus the length in terms of the number of cigarettes in the accumulated layer. A digital signal representing the state of the counter 38 is applied to proportional regulator means 42, which also has applied to it by way of a conductor 39 the target value of the length of the accumulated layer expressed digitally as a given ideal number of cigarettes. Only after formation of the setting signal is this translated by means of a digital-analogue converter 44 into an analogue signal, which is applied as shown to regulate drive means 46 of the trough belt 32 or to regulate the rate operation of the entire machine connected downstream of the trough belt 32.

I claim

1. Apparatus in a high speed continuous cigarette processing plant for maintaining substantially constant the length of an accumulated layer of cigarettes, the apparatus comprising in combination:

(a) means for carrying cigarettes in a predetermined direction;

(b) charging means to displace said cigarettes transversely to the respective longitudinal dimensions thereof and thereby to load said cigarettes onto said carrier means to be accumulated thereon side-by-side in a single gapless layer;

(c) discharging means disposed downstream of said carrier means to remove said cigarettes in uniform sequence from said carrier means;

(d) means to provide a target signal indicative of the optimum length of said accumulated layer of cigarettes;

(e) first sensor means disposed to sense the passage of each cigarette loaded onto said charging means from said carrier means and to provide a first signal indicative of said passage;

(f) second sensor means disposed to sense the passage of each cigarette removed from said charging means to said discharing means and to provide a second signal indicative of said passage;

(g) a reversible digital counter arranged to count forwardly in response to said first signal and to count backwardly in response to said second signal; and (h) means responsive to a control signal indicative of an instantaneous count state of said reversible counter and responsive to said target signal to so control the rate at which said cigarettes are removed from said carrier means by said discharging means that said length of said accumulated layer of cigarettes is maintained substantially constant.

* * * * *